US005603641A

United States Patent [19]

Kuhn et al.

[11] Patent Number: 5,603,641

[45] Date of Patent: Feb. 18, 1997

[54] ELECTRICAL CONNECTOR ASSEMBLY ALIGNMENT STRUCTURE

[75] Inventors: Brent A. Kuhn, Novi; Lawrence M. Suwinski, Sr., Clinton Township, Macomb County, both of Mich.; Chong H. Yi, Middletown, Pa.

[73] Assignee: United Technologies Automotive Inc., Dearborn, Mich.

[21] Appl. No.: 410,123

[22] Filed: Mar. 23, 1995

[51] Int. Cl.[6] ..... H01K 13/64

[52] U.S. Cl. ..... 439/680

[58] Field of Search ..... 439/679, 680, 439/681; 29/874, 876, 883; 264/328.1

[56] References Cited

U.S. PATENT DOCUMENTS 3,351,886 11/1967 Zimmerman ..... 439/680
3,714,617 1/1973 Bright et al. ..... 439/681
4,913,484 4/1990 Dowd et al. ..... 297/97.12
5,211,574 5/1993 Van Wyk ..... 439/680
5,376,016 12/1994 Inaba et al. ..... 439/364

*Primary Examiner*—Neil Abrams
*Assistant Examiner*—Barry Matthew L. Standig
*Attorney, Agent, or Firm*—Harness Dickey & Pierce, P.L.C.

[57] ABSTRACT

An electrical connector assembly includes a connector having a body, a conductive terminal, a cavity and a pair of flexible walls defining a keyway therebetween. A second electrical connector having a protruding finger with a tab transversely extending therefrom is insertable into the cavity and keyway of the first electrical connector such that the tab is sized to press firmly against the keyway walls so as to flexibly expand them away from each other.

21 Claims, 3 Drawing Sheets

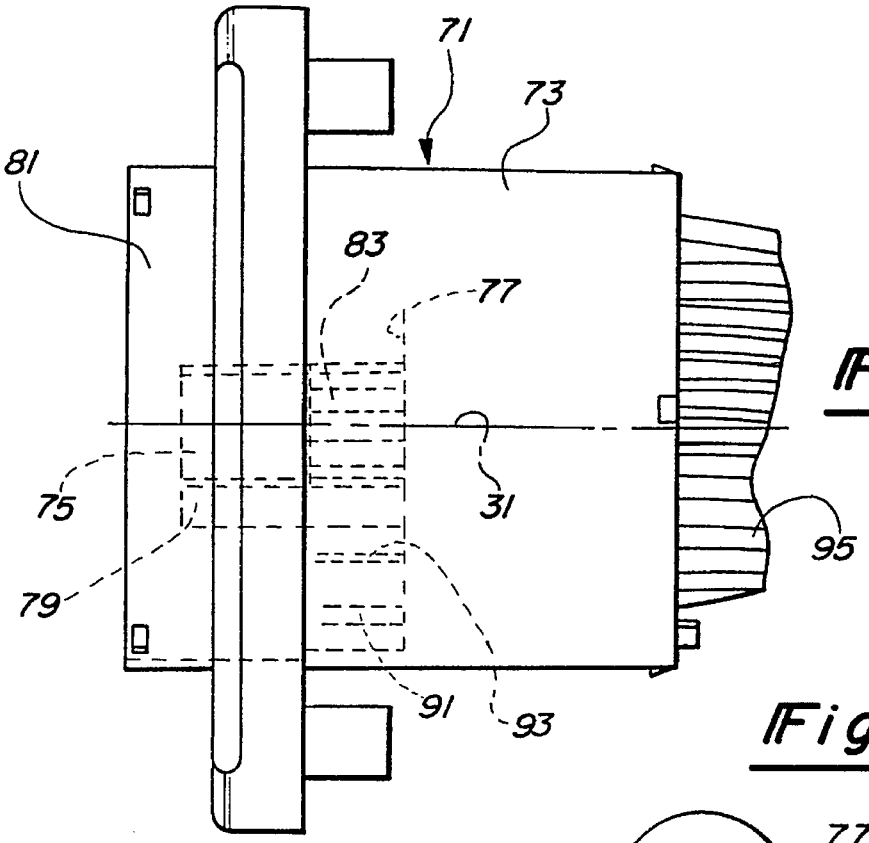
Fig-5
Fig-6
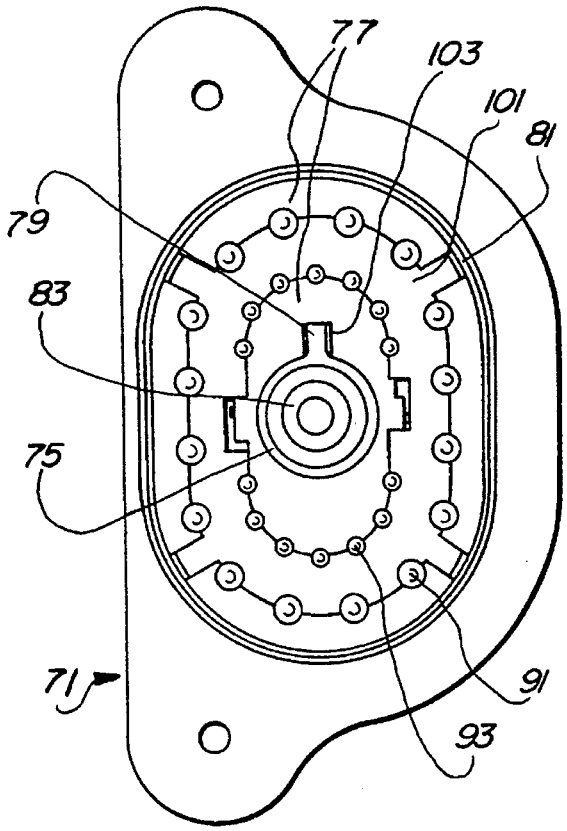
Fig-7
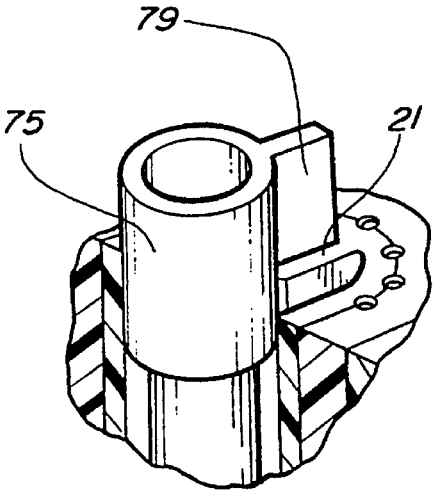

ELECTRICAL CONNECTOR ASSEMBLY ALIGNMENT STRUCTURE

BACKGROUND OF THE INVENTION

This invention relates generally to electrical connectors and specifically to an alignment structure within an electrical connector assembly.

Recently, the demand for electrical features within automotive vehicles has greatly expanded. Such electrical features include motorized mirrors, motorized windows, motorized seat adjusters, motorized trunk lid pull down latches, navigational CRT displays, compact disc players and the like. This increase in electrical devices has necessitated more wire harnesses and the related electrical connectors.

Alignment and mating of electrical connectors on a moving assembly line is often problematic. Electrically conductive terminals within the electrical connectors are often inadvertently bent or broken during mating due to poor alignment of the connectors. This usually leads to intermittent electrical failures which are annoying to vehicle users and are difficult to trace during service.

One traditional connector assembly comprises a first connector having a centrally located finger extending from an internal face thereof. An axially running tab transversely projects from an external surface of the finger. A plurality of high and low current male terminals perpendicularly project from the same face of the electrical connector as does the finger. The second connector, illustrated in FIG. 1, contains a centrally located cylindrical cavity having a keyway transversely projecting therefrom. The keyway is defined by a pair of stationary walls disposed substantially parallel to a longitudinal mating axis of the connector. The pair of walls defining the keyway are prevented from flexing by having distal edges, located closest to the cavity, rigidly connected to a body of the connector. The finger and tab of the first electrical connector are inserted into the respective cavity and keyway of the second electrical connector prior to mating of the male and female terminals. However, due to part shrinkage after molding as well as temperature and humidity variations, the tab is designed to have clearance to the walls of the keyway. Thus, reliable and constant alignment of the connectors are difficult to achieve such that terminals often become bent or broken upon mating. Furthermore, precise dimensional control of the keyway walls and tab has proven difficult and costly. Cross threading of a bolt used to retain the two connectors together can also be a problem if the connectors are misaligned or the tab does not allow full insertion into the keyway due to tolerance mismatches. It must also be understood that damage to this type of electrical connector often requires the vehicle assembler to discard the entire connector and wire harness assembly.

SUMMARY OF THE INVENTION

In accordance with the present invention, a preferred embodiment electrical connector assembly employs a novel alignment structure. This electrical connector assembly includes a connector having a body, at least one conductive terminal, a cavity, and a pair of flexible walls defining a keyway therebetween. A second electrical connector having a protruding finger with a tab transversely extending therefrom is insertable into the cavity and keyway of the first electrical connector such that the tab is sized to press firmly against the keyway walls so as to flexibly expand them away from each other.

The present invention is advantageous over prior constructions by insuring precise and repeatable alignment of two electrical connectors prior to and during mating of their respective electrical terminals. The present invention electrical connector assembly is less expensive to manufacture due to expanded part tolerances. Furthermore, the electrical connector assembly of the present invention reduces both molding and assembly scrap and cost. The present invention is further advantageous in that inadvertent terminal push-out, bending or breakage is reduced due to improved alignment. Bolt cross threading is also eliminated by employing the electrical connector assembly of the present invention. Additional advantages and features of the present invention will become apparent from the following description and appended claims, taken in conjunction with the accompanying drawings.

BRIEF DESCRIPTION OF THE DRAWINGS

FIG. 5 is a side elevational view showing the preferred embodiment of a second electrical connector employed in the present invention electrical connector assembly;

FIG. 6 is an end elevational view showing the second electrical connector of the present invention of FIG. 5;

FIG. 7 is a fragmentary perspective view showing a finger and tab of the first electrical connector inserted into a cavity and keyway of the second electrical connector of the present invention of FIGS. 2–6.

DETAILED DESCRIPTION OF THE PREFERRED EMBODIMENT

In accordance with the present invention, an electrical connector assembly includes a pair of mating electrical connectors aligned by an alignment structure and retained by a bolt. Such electrical connectors are commonly employed to join two or more wire harnesses within an automotive vehicle door, instrument panel, passenger compartment or engine compartment.

Figure 1:
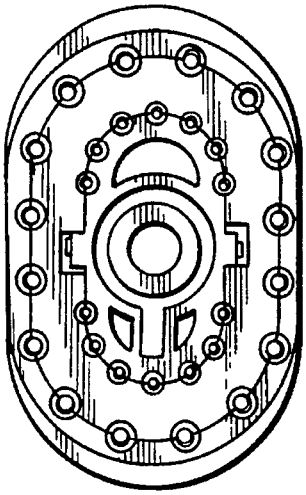
Fig-1 PRIOR ART
FIG. 1 is an end elevational view showing a prior art electrical connector.
Figure 2:
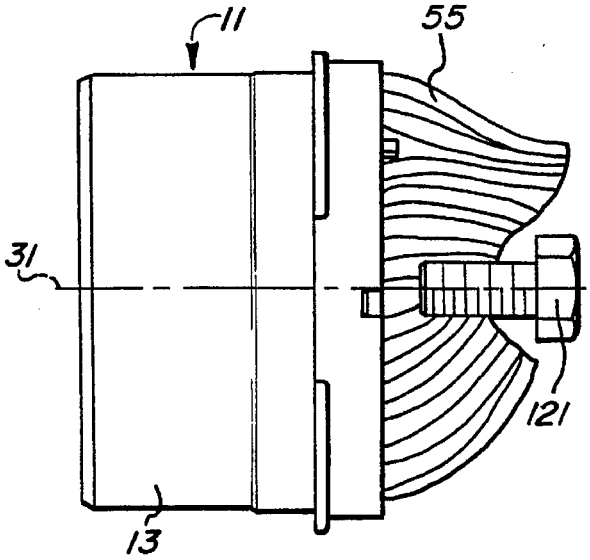
FIG. 2 is a side elevational view showing the preferred embodiment of a first electrical connector and bolt of the electrical connector assembly of the present invention.
Figure 3:
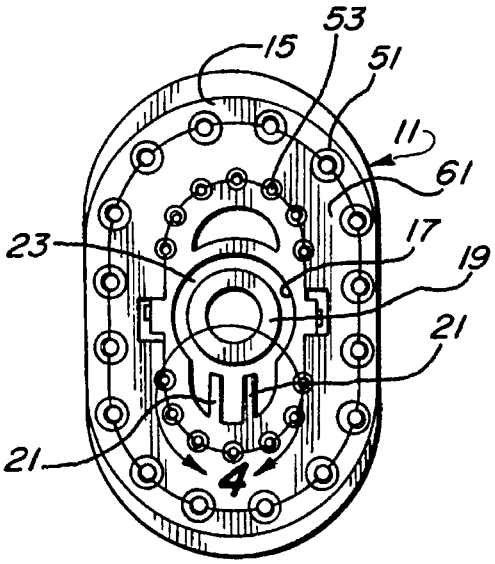
FIG. 3 is an end elevational view showing the present invention first electrical connector of FIG. 2.
Figure 4:
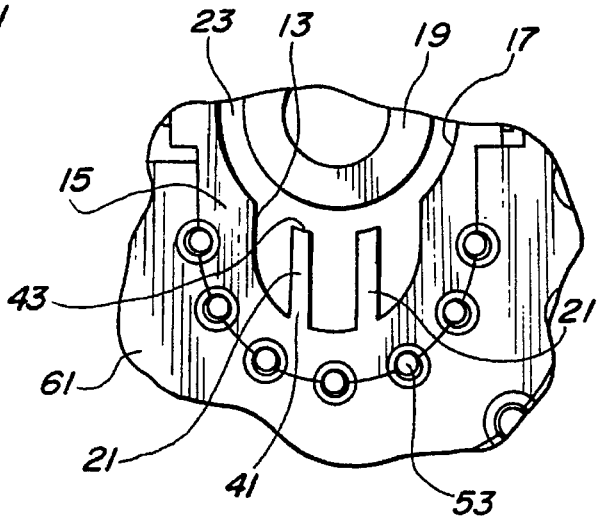
FIG. 4 is an enlarged fragmentary end view, taken within circle 4 of FIG. 3, of the present invention first electrical connector.

Referring to FIGS. 2–4, a preferred embodiment of a first electrical connector 11 of the present invention consists of a body 13, having a transversely oriented mating face 15, an internal surface 17, a hollow cylindrical boss 19 and a pair of keyway walls 21. Internal surface 17, hollow cylindrical boss 19 and key-way walls 21 are oriented substantially perpendicular to face 15. A floor 23 connects boss 19 to body 13, however, boss 19 is internally open at both ends. Internal surface 17 defines a substantially cylindrical cavity running along a longitudinal mating axis 31. Walls 21 are oriented to run substantially parallel to mating axis 31 and are partially connected at one end to floor 23. The keyway is open to both the cavity and mating face 15. Each wall 21 has a proximal edge 41 molded as part of body 13. Each wall 21 further has a distal edge 43 detached from the surrounding body 13 so as to allow a majority segment of each wall 21 to flex as is shown in FIG. 7. Body 13 of electrical connector 11 is preferably injection molded from VALOX® which can be purchased from GE Plastics Co.

A set of high current electrical terminals 51 are of a female receptacle variety and are openly accessible from mating face 15. An inner set of low current electrical terminals 53 are also of a female receptacle variety and are smaller than terminals 51. Terminals 53 are also openly accessible from mating face 15. These terminals 51 and 53 are preferably of the type disclosed within U.S. Pat. No. 3,482,207 entitled "Electric Terminal" which issued to Cairns on Dec. 2, 1969, the disclosure of which is incorporated by reference herewithin. However, alternate terminals, such as those disclosed within U.S. Pat. Nos. 4,531,808 and 4,238,140, both of which issued to Cairns et al., can be employed within either the first or second connectors of the present invention. A plurality of discrete wires 55, which constitute a wire harness wrapped in electrical tape, are crimped onto stamped metallic terminals 51 and 53. A substantially nonconductive engineering grade polymeric retention ring 61 is snap fittably inserted within body 13 between the sets of terminals 51 and 53.

As is best illustrated in FIGS. 5 and 6, a preferred embodiment of a second electrical connector 71 of the present invention consists of a body 73, a hollow cylindrical finger 75 perpendicularly projecting from a transversely oriented mating face 77, a tab 79 and a shroud 81. Tab 79 transversely extends from finger 75 and runs substantially parallel with mating axis 31. An internally threaded collar 83, having open ends, is longitudinally positioned within finger 75. A set of high current male electrical terminals 91 and a set of smaller low current electrical terminals 93 are crimped onto discrete wires 95 of another tape-wrapped wire harness. Terminals 91 and 93 project perpendicular to mating face 77 and are preferably made in accordance with the previously referenced U.S. Pat. No. 3,482,207. A substantially nonconductive engineering grade polymeric retention ring 101 is snap-fittably mounted within body 73 between high and low current sets of electrical terminals 91 and 93, respectively. Electrical connector 71 is also preferably made from VALOX®. A lead-in taper 103 is provided upon a leading edge of tab 79. Tab 79 has a transverse cross sectional width greater than the tab employed with the prior art device.

Figure 8:
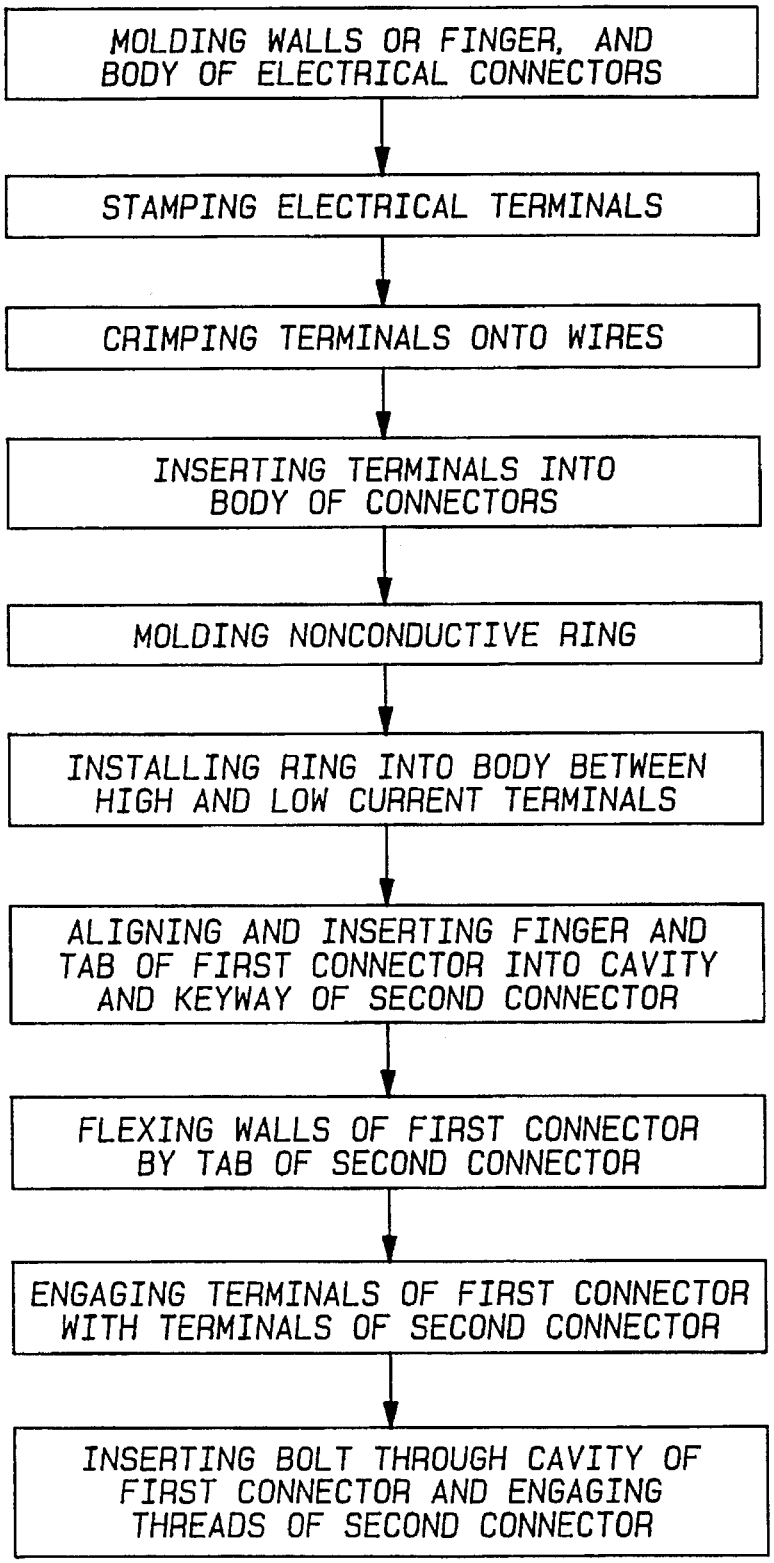
FIG. 8 is a diagrammatic flow chart showing the manufacturing and assembly steps employed in conjunction with the electrical connector assembly of the present invention of FIGS. 2–7.

Referring now to FIGS. 4, 6 and 7, as well as the assembly steps shown in FIG. 8, the alignment and mating steps employed with the electrical connector assembly of the present invention will now be described in greater detail. Finger 75 and tab 79 of second electrical connector 71 are aligned and then pushably inserted within the cavity and keyway of first electrical connector 11. Accordingly, tab 79 causes distal edges 43 of keyway walls 21 to transversely and rotatably flex away from each other. The transverse dimension of tab 79 is preferably 0.05 millimeters greater than the keyway space between keyway walls 21. Thus, walls 21 tightly press against tab 79 thereby aligning connectors 11 and 71 throughout the remaining mating of the male and female terminals. The aligned interaction between tab 79 and walls 21 further prevent rotational play between connectors 11 and 71 both during and after installation. Referring now to FIGS. 2, 6 and 8, a bolt 121 is inserted through boss 19 (see FIG. 3) from back side of first connector 11. External threads of bolt 121 are then engaged by internally threaded collar 83 of second electrical connector 71. This is preferably done by use of a power preset torque limiting driver thereby firmly securing connectors 11 and 71 together.

While the preferred embodiment of an electrical connector assembly has been disclosed, it will be appreciated that various modifications may be made without departing from the present invention. For example, the electrical connector containing the flexible keyway walls can also contain male or other configured electrical terminals. Furthermore, the keyway walls and mating tab may be mounted upon their respective electrical connectors external to the electrical terminals. Multiple alignment structures may also be employed. Moreover, multiple tabs or even tabs of different configurations may be used in combination with the present invention flexible keyway walls. Of course, the cavity and keyway may be mounted on the opposite connector than that described heretofore. The cavity and keyway may also extend beyond the mating face. A barb and slotted snap fit means may also be employed to fasten the shroud to the body of the other connector rather than or in addition to the disclosed bolt and collar. Junction boxes, lamps, fuse holders, electric motors or other mating electrical items may also employ the present invention alignment structure. Various materials and processes have been disclosed in an exemplary fashion, however, other materials and processes may be employed. It is intended by the following claims to cover these and any other departures from the disclosed embodiments which fall within the true spirit of this invention.

The invention claimed is:

1. An electrical connector assembly including a first connector comprising:

a body;

an electrical terminal at least partially disposed within said body;

a cavity at least partially disposed within said body and being elongated along a mating axis;

a pair of walls each having substantially parallel sides and a distal edge accessible to said cavity, said sides and distal edge longitudinally running substantially parallel to said mating axis, a majority of said pair of walls being attached to said body, said pair of walls defining a slotted keyway therebetween open to said cavity;

said distal edges of said pair of walls, defined as those closest to a center of said cavity, and said sides of said pair of walls being freely movable independent from said body along portions thereof, thereby allowing a segment of each of said pair of walls to flex away from each other; and said pair of walls and said body being molded as a single integrated unit.

2. The electrical connector assembly of claim 1 further including a second connector mateable with said first connector, said second connector comprising:

a body;

a finger protruding along said mating axis;

a tab transversely extending from said finger;

an electrical terminal electrically connectable with said electrical terminal of said first connector; and said finger insertable within said cavity and said tab insertable within said keyway such that said segment of each of said pair of walls of said first connector firmly press against and are flexibly expanded when said tab is inserted therebetween, the interaction between said pair of walls and said tab aiding to rotationally align said electrical connectors immediately prior to and during engagement of said electrical terminals; and said finger and said body being integrally formed as a single piece.

3. The electrical connector assembly of claim 2 wherein:

a first mating face is transversely oriented upon said body of said first connector, said electrical terminal is accessible from said first mating face, said cavity and said keyway are also open toward said first mating face; and a second mating face is transversely oriented upon said body of said second connector, said finger protrudes from said second mating face, said electrical terminal of said second connector accessible from said second mating face.

4. The electrical connector assembly of claim 3 wherein said finger is centrally located to protrude substantially perpendicular from said mating face of said second connector with a plurality of said electrical terminals interspersed to surround said finger, said plurality of said electrical terminals also projecting substantially perpendicular from said mating face of said second connector.

5. The electrical connector assembly of claim 4 wherein said second connector further includes an outer shroud located at a portion of said mating face transversely outboard of said plurality of said electrical terminals and longitudinally projecting beyond said plurality of said electrical terminals along said mating axis.

6. The electrical connector assembly of claim 2 wherein said finger has an annular configuration with a hollow bore therein.

7. The electrical connector assembly of claim 6 further comprising:

a threaded collar disposed within said bore of said finger; and a bolt insertable through said cavity of said first connector and enmeshable with said threaded collar of said second connector for preventing unintended disengagement between said connectors.

8. The electrical connector assembly of claim 2 wherein said connectors also have means for snap-fit fastening to one another.

9. The electrical connector assembly of claim 2 wherein said electrical terminals of said second connector are defined as male terminals.

10. The electrical connector assembly of claim 2 wherein said electrical terminals of both said first and second connectors include sets of high current terminals and sets of low current terminals.

11. The electrical connector assembly of claim 1 wherein said cavity of said first connector has a substantially cylindrical portion.

12. The electrical connector assembly of claim 1 wherein a plurality of said electrical terminals of said first connector are further defined as female terminals with a plurality of discrete insulated wires electrically coupled thereto.

13. The electrical connector assembly of claim 1 wherein a plurality of said electrical terminals of said first connector are further defined as male terminals with a plurality of discrete insulated wires electrically coupled thereto.

14. An electrical connector assembly comprising:

a first connector including:

a body having a substantially transversely oriented mating face thereon;

a plurality of electrical conductive terminals accessible from said mating face;

a cavity open toward said mating face and being elongated along mating axis;

a pair of walls defining a slotted keyway therebetween open to said cavity and said mating face;

a majority of said pair of walls being attached to said body;

distal edges of said pair of walls, defined as those closest to a center of said cavity, being freely movable independent from said body along portions thereof, thereby allowing a segment of each of said pair of walls to transversely flex away from each other;

a second connector including:

a body having a substantially transversely oriented mating face thereon;

a finger protruding from said mating face along said mating axis;

a tab transversely extending from said finger;

a plurality of electrical terminals accessible from said mating face and electrically connecting with said plurality of electrical terminals of said first connector;

said finger inserted within said cavity and said tab inserted within said keyway such that said segment of each of said pair of walls of said first connector firmly press against and are flexibly expanded by said tab being inserted therebetween, the interaction between said pair of walls and said tab aiding to align said electrical connectors;

said finger located to protrude substantially perpendicular from said mating face of said second connector with said plurality of electrical terminals interspersed to surround said finger, said plurality of electrical terminals also projecting substantially perpendicular from said mating face of said second connector; and said second connector further includes an outer shroud projecting from a portion of said mating face transversely outboard of said plurality of electrical terminals and longitudinally beyond said plurality of electrical terminals along said mating axis.

15. A method for mating first and second electrical connectors together comprising the steps of:

(a) aligning a tab of said first connector with a keyway of said second connector, said keyway oriented along a mating axis and defined by a pair of walls on either side thereof;

(b) inserting said tab into said keyway in the direction of said mating axis;

(c) contacting a majority of said tab against a majority of interior sides of said pair of walls;

(d) flexing at least a segment of each of said pair of walls;

(e) engaging a male electrical terminal with a female electrical terminal; and (f) retaining said connectors to each other.

16. The method of claim 15 further comprising the step of:

(a) decreasing rotational movement of said first connector in relation to said second connector upon inserting said tab into said keyway.

17. The method of claim 15 further comprising the steps of:

(a) attaching a first discrete wire to said terminal of said first connector; and (b) attaching a second discrete wire to said terminal of said second connector.

18. The method of claim 15 further comprising the steps of:

(a) inserting a bolt through a cavity within said first connector; and (b) engaging threads of said bolt with a portion of said second connector.

19. A method of creating an electrical connector comprising the steps of molding a pair of walls projecting from a body and into a cavity, molding lateral sides of each of said pair of walls to be accessible from said cavity, molding said pair of walls to be accessible to a mating face of said body, a majority of said pair of walls being attached to said body, allowing said pair of walls to flex, whereby said pair of walls encompasses repeatable alignment of said electrical connector with a mating connector.

20. The method of claim 19 further comprising the steps of:

(a) assembling first conductive members to first electrical terminals; and (b) inserting said first electrical terminals into said body.

21. The method of claim 20 further comprising the steps of:

(a) assembling second conductive members to second electrical terminals, said first and said electrical terminals having different sizes;

(b) inserting said second electrical terminals into said body; and (c) installing a substantially nonconductive retention ring between said first and second electrical terminals.

* * * * *